US005521346A

United States Patent [19]

Castonguay et al.

[11] Patent Number: 5,521,346

[45] Date of Patent: May 28, 1996

[54] SEQUENTIAL CLOSE INTERLOCK ARRANGEMENT FOR HIGH AMPERE-RATEDCIRCUIT BREAKER

[75] Inventors: Roger N. Castonguay, Terryville; Mark A. Zaffetti, Windsor Locks; James L. Rosen, West Hartford, all of Conn.

[73] Assignee: General Electric Company, New York, N.Y.

[21] Appl. No.: 266,409

[22] Filed: Jun. 27, 1994

[51] Int. Cl.[6] ..... H01H 23/00

[52] U.S. Cl. ..... 200/401; 200/400

[58] Field of Search ..... 200/400, 401; 335/185, 186, 187, 188, 189, 190, 191

[56] References Cited

U.S. PATENT DOCUMENTS

| | | | |
|---|---|---|---|
| 3,689,721 | 9/1972 | McGuffie | 200/400 |
| 4,001,742 | 1/1977 | Castonguay et al. . | |
| 4,324,960 | 4/1982 | Maier et al. | 200/318 |
| 4,491,814 | 1/1985 | Bellows | 200/401 |
| 4,641,001 | 2/1987 | Fujihisa et al. | 200/318 |

OTHER PUBLICATIONS

Castonguay et al, "Operating Mechanism for High Ampere-rated Circuit"; U.S. Ser. No.: 08/202,140 (Docket: 41PR-7116)-Filed Feb. 24, 1995.

Castonguay et al, "Handle Operator Assembly for High Ampere-rated Circuit Breaker" U.S. Ser. No.: 08/214,522 (Docket: 41PR-7130)-Filed Mar. 18, 1994.

Castonguay et al, "A Latching Arrangement for High-rated Circuit Breaker Operating Springs"; U.S. Ser. No.: 08/218,287(Docket:41PR-7131)-Filed Mar. 18, 1994.

Castonguay et al, "Rating Module Unit for HIgh Ampere-rated Circuit Breaker" U.S. Ser. No.: 08/203,062 (Docket:41PR-7124) Filed Feb. 28, 1994.

*Primary Examiner*—David J. Walczak
*Attorney, Agent, or Firm*—Richard A. Menelly

[57] ABSTRACT

This invention relates to a high ampere-rated circuit breaker which meets the electrical code requirements of the world market. The charging of the powerful operating springs controlling the circuit breaker contacts is made manually by means of a ratchet and pawl assembly. A two stage latching arrangement controls the retention and release of the pawl to retain and discharge the operating springs. The latches are interlocked with the operating springs drive shaft to prevent the discharge of the operating springs when the contacts are in the closed condition.

10 Claims, 5 Drawing Sheets

SEQUENTIAL CLOSE INTERLOCK ARRANGEMENT FOR HIGH AMPERE-RATEDCIRCUIT BREAKER

BACKGROUND OF THE INVENTION

U.S. Pat. No. 4,001,742 filed Jan. 4, 1977 entitled "Circuit Breaker Having Improved Operating Mechanism" describes a circuit breaker capable of interrupting several thousand amperes of circuit current at several hundred volts potential. As described therein, the operating mechanism is in the form of a pair of powerful operating springs that are restrained from separating the circuit breaker contacts by means of a latching system. Once the operating mechanism has responded to separate the contacts, the operating springs must be recharged to supply sufficient motive force to the movable contact arms that carry the contacts.

U.S. patent application Ser. No. 08/202,140 filed Feb. 25, 1994 entitled "Operating mechanism for high ampere-rated circuit breaker" describes an operating mechanism capable of immediately closing the circuit breaker operating mechanism to reclose the contacts without having to recharge the circuit breaker operating springs immediately after opening the circuit breaker contacts.

U.S. patent application Ser. No. 08/203,062 filed Feb. 28, 1994 entitled "Rating module unit for high ampere-rated circuit breaker" describes a circuit breaker closing spring modular unit whereby the circuit breaker operating springs are contained within a separate unit from the operating mechanism and can be installed within the circuit breaker enclosure without disturbing the operating mechanism assembly.

U.S. patent application Ser. No. 08/214,522 filed Mar. 18, 1994 entitled "Handle operator assembly for high ampere-rated circuit breaker" describes a handle operator unit capable of generating large spring charging forces by means of an externally-accessible manually operated handle. A ratchet and pawl assembly allows the manually-applied charging forces to be applied to the operating springs. Once the circuit breaker operating mechanism closing springs are fully-charged, some means must be employed to release the pawl to allow the closing springs to become fully operational.

U.S. patent application Ser. No. 08/218,287 filed Mar. 28, 1994 entitled "A Latching Arrangement for High Ampere-rated Circuit Breaker Operating Springs" describes a two-stage latching arrangement that controls the retention and release of a ratchet pawl to retain and discharge the operating springs.

To prevent the circuit breaker operating mechanism from releasing the operating springs when the circuit breaker contacts are already closed, complex interlock schemes are usually interposed between the circuit breaker closing system and the operating mechanism.

This invention proposes a simple and efficient interlock arrangement to automatically retain the circuit breaker operating springs until the circuit breaker contacts are in the open condition.

SUMMARY OF THE INVENTION

The circuit breaker operating mechanism operating springs are charged by means of an externally accessible handle that includes a handle drive gear and pawl assembly. An interlock arrangement prevents the operating springs from operating free from the pawl assembly until and unless the circuit breaker contacts are in the open condition. A D-latch interfaces directly with the pawl assembly and interfaces with the operating mechanism drive shaft through a linkage assembly to release the latch from the pawl when the drive shaft is in the open contact position.

DESCRIPTION OF THE PREFERRED EMBODIMENT

Figure 1:
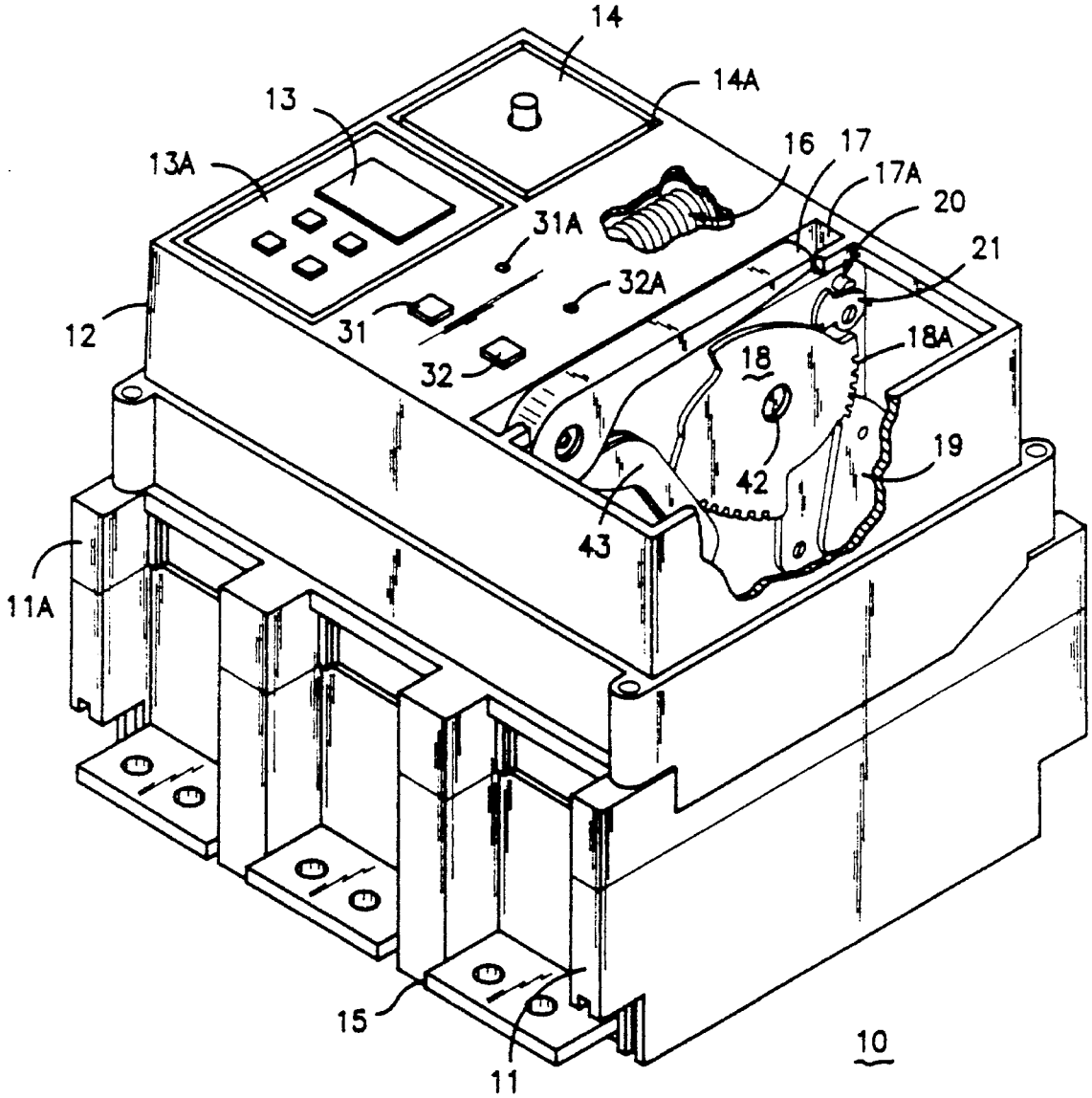
FIG. 1 is a top perspective view of a high ampere-rated circuit breaker with a portion of the circuit breaker cover removed to depict the operating springs interlock assembly according to the invention.

The high ampere-rated circuit breaker 10 shown in FIG. 1 is capable of transferring several thousand amperes quiescent circuit current at several hundred volts potential without overheating. The circuit breaker consists of an electrically insulated base 11 to which an intermediate cover 11A of similar insulative material is attached prior to attaching the top cover 12, also consisting of an electrically-insulative material. Electrical connection with the interior current-carrying components is made by load terminal straps 15 extending from one end of the base and line terminal straps (not shown) extending from the opposite end thereof. The interior components are controlled by an electronic trip unit 13 contained within a recess 13A in the top surface of the top cover 12. Although not shown herein, the trip unit is similar to that described within U.S. Pat. No. 4,658,323 and interacts further with an accessory 14 contained within the accessory recess 14A to provide a range of protection and control functions such as described, for example within U.S. Pat. No. 4,801,907. The operating mechanism as described within the aforementioned U.S. patent application Ser. No. 08/203,062 includes a closing shaft 42 which interacts with the powerful operating mechanism springs 16. The operating handle 17 located within the handle recess 17A allows manual operation of the circuit breaker operating mechanism as well as providing manual means for charging the operating mechanism springs through operation of the handle drive lever 43 and the handle drive gear 18. The handle drive gear includes a series of handle drive teeth 18A that interact with a locking pawl 19 to restrain the handle drive gear from reverse rotation during the operating spring charging process as described in the aforementioned U.S. patent application Ser. No. 08/218,287. As described within the Patent Application, a two stage operating springs latching assembly consisting of an intermediate latch 21 at the top of the handle drive gear 18 and a primary latch 20 arranged at the top of the intermediate latch interacts with the locking pawl 19 to prevent rotation of the closing shaft 42 while the operating springs are being charged. A pair of buttons 31, 32 arranged on the top cover 12 to open and close the circuit breaker contacts, operation of which is indicated on the associated LEDs 31A, 32A, respectively.

Figure 2:
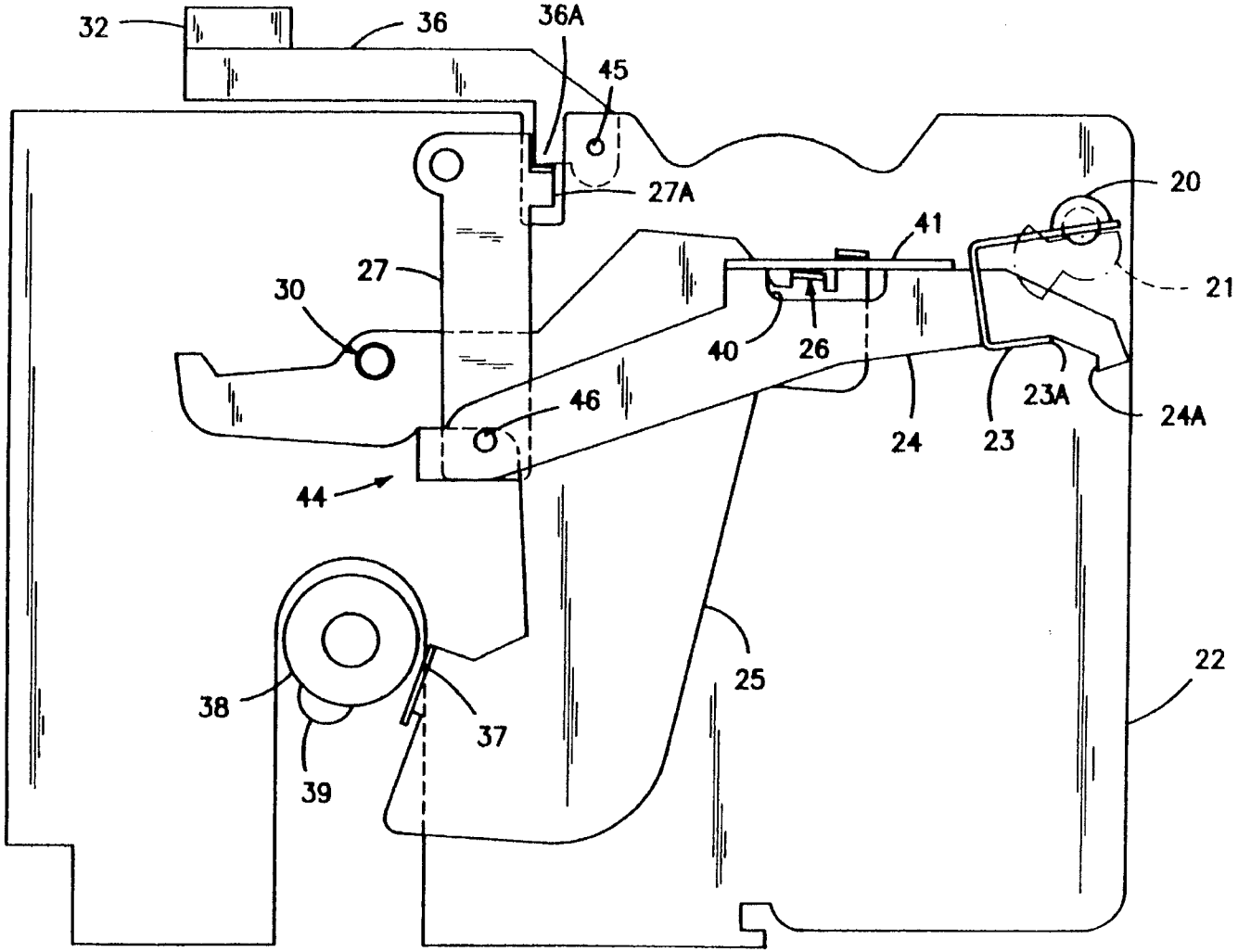
FIG. 2 is an enlarged plan side view of the operating springs interlock assembly of FIG. 1 when the circuit breaker contacts are in the open condition.

In accordance with the teachings of this invention, the close button 32 is interlocked in order to prevent the operating mechanism springs from being closed when the circuit breaker contacts are already in the closed condition. To this end, the interlock assembly depicted in FIG. 2 is employed. When the circuit breaker contacts are in the open condition, the drive shaft 38 which controls the open and closed conditions of the circuit breaker contacts is in the rotational position depicted in FIG. 2 with the protrusion 39 on the shaft away from the positioning tab 37 at one end of the closing interlock link 25. The interlock link 25 rotates about the pivot 30 arranged on the operating mechanism sideframe 22. The close button 32 interacts with the interlock assembly 44 by connection with a closing lever 36 which is pivotally attached to the sideframe by means of the pivot 45. A tab 36A on the lever 36 is positioned over a tab 27A extending from interconnecting link 27. The interconnecting link in turn is pivotally attached to the closing link 24 by means of the pivot 46. Interaction between the closing link 24 and the interlock link 25 is achieved by capture of the interlock tab 26 on the interlock link 25 within the closing slot 40 formed in the closing link 24. The interlock tab 26 contacts the top 41 of the closing link 24 when the circuit breaker contacts are in the open condition and when the protrusion 39 on the drive shaft 38 is away from the positioning tab 37 at the end of the interlock link 25. In this position, the end 24A of the closing link 24 is in line with the end 23A of the primary latch bracket 23. The primary latch 20 on the primary latch bracket is in contact with the intermediate latch 21 shown in phantom so that the operating mechanism springs are unable to close.

Figure 3:
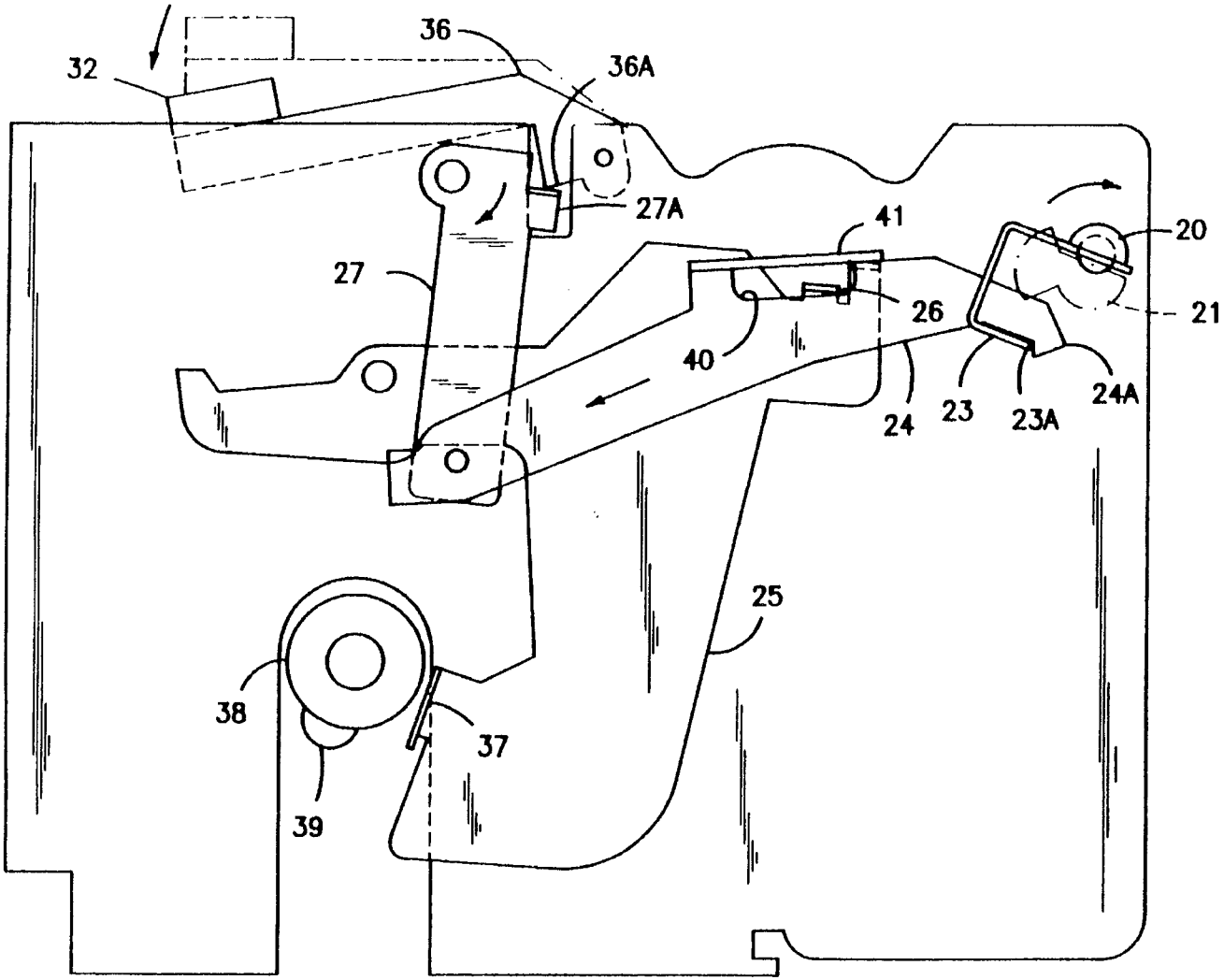
FIG. 3 is an enlarged plan side view of the operating springs interlock assembly of FIG. 2 when the circuit breaker contacts are in the open condition and the close button is depressed.

When the close button 32 is depressed while the protrusion 39 on the drive shaft 38 is away from the positioning tab 37 on the interlock link 25, as shown in FIG. 3, the closing lever 36 moves the tab 36A downwards moving the interconnecting link 27 clockwise and drawing the attached closing link 24 diagonally downwards and moving the top 41 of the closing slot 40 away from the interlock tab 26 on the interlock link 25. The end 24A of the closing link 24 is driven against the end 23A of the bracket 23 displacing the primary latch 20 away from the secondary latch 21 which releases the operating springs, to close the circuit breaker contacts in the manner described within the aforementioned U.S. patent application Ser. No. 08/218,287 filed Mar. 28, 1994 entitled "A Latching Arrangement for High Ampere-rated Circuit Breaker Operating Springs".

Figure 4:
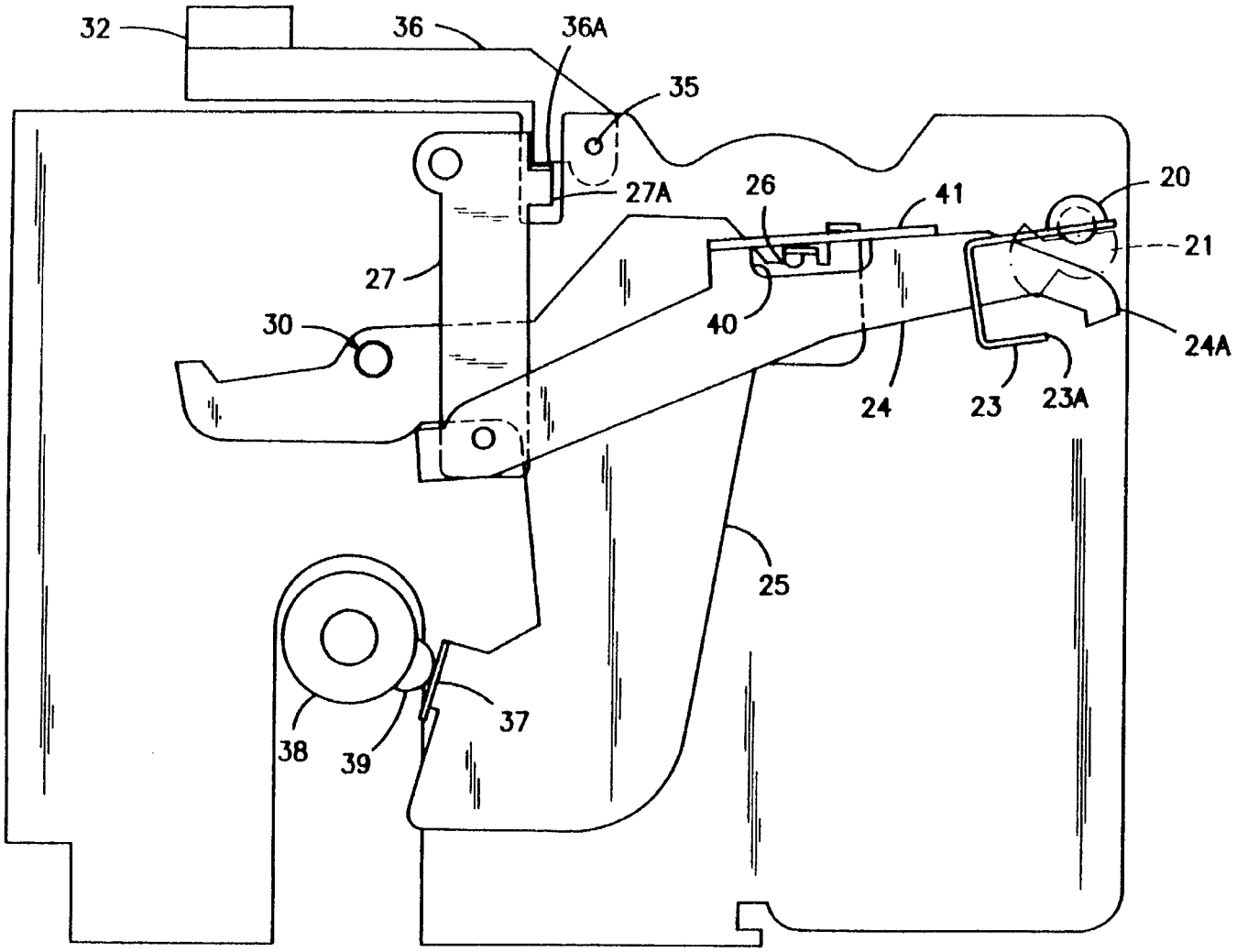
FIG. 4 is an enlarged plan side view of the operating springs interlock assembly of FIG. 1 when the circuit breaker contacts are in the closed condition.

With the circuit breaker contacts now in the closed condition, the drive shaft 38 is in the rotational position depicted in FIG. 4 with the protrusion 39 on the shaft against the positioning tab 37 at the end of the closing interlock link 25. The close button 32 and closing lever 36 return to the original position about the pivot 35 with the tab 36A away from the tab 27A on the interconnecting link 27. The closing tab 26 is against the top 41 of the closing slot 40 and the end 24A of the closing link 24 is away from the end 23A of the bracket 23. The primary latch 20 and the secondary latch 21 are in the latched position with respect to the circuit breaker operating springs.

Figure 5:
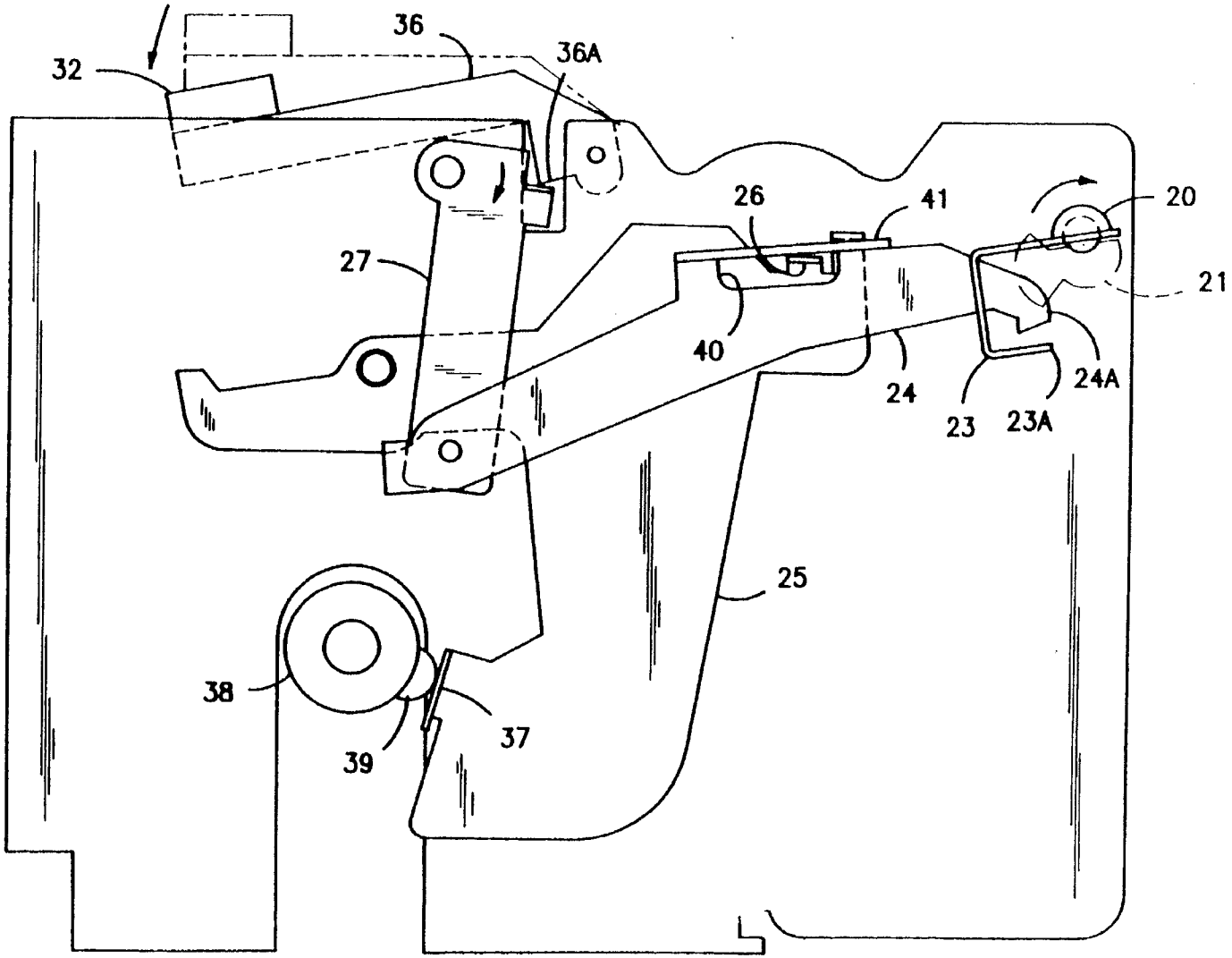
FIG. 5 is an enlarged plan side view of the operating springs interlock assembly of FIG. 2 when the circuit breaker contacts are in the closed condition and the close button is depressed.

When the close button 32 is depressed while the protrusion 39 on the drive shaft 38 is against the positioning tab 37 on the interlock link 25, as shown in FIG. 5, the closing lever 36 moves the tab 36A downwards moving the interconnecting link 27 clockwise. However, the attached closing link 24 is unable to move the top 41 of the closing slot 40 away from the interlock tab 26 on the interlock link 25. The end 24A of the closing link 24 is unable to contact the end 23A of the bracket 23 to displace the primary latch 20 away from the secondary latch 21 to release the operating springs to close the circuit breaker contacts. In order for the close button 32 to become operable to close the circuit breaker operating springs, the protrusion 39 on the drive shaft 38 must be away from the tab 37 on the interlock link 25 as depicted earlier in FIGS. 2 and 3.

A simple interlock arrangement has herein been described for preventing the circuit breaker operating springs from being released unless and until the circuit breaker contacts are in the open condition.

I claim:

1. An industrial-rated circuit breaker for high level overcurrent protection comprising:

an insulative base;

an insulative cover above said base, said cover enclosing a closing shaft and a drive shaft;

a closing spring for connecting with said closing shaft, said closing spring adapted for rotating said closing shaft and driving circuit breaker contacts to a closed condition;

close means operatively connecting with said closing spring for allowing an operator to release said closing spring for moving circuit breaker contacts to a closed condition;

a closing latch arrangement operatively connecting with said closing shaft for preventing said closing shaft from rotation under urgence of said closing spring until said closing spring becomes fully charged; and an interlock assembly interacting between said close means and said drive shaft for preventing release of said closing spring when said circuit breaker contacts are in a closed condition and said close means is actuated.

2. The circuit breaker of claim 1 wherein said closing latch arrangement includes a primary latch and an intermediate latch.

3. The circuit breaker of claim 2 wherein said interlock assembly includes an interlock lever, one end of said interlock lever interfacing with said drive shaft.

4. The circuit breaker of claim 2 including a closing lever connected with said close means at one end and pivotally connected with a sideframe at an opposite end.

5. The circuit breaker of claim 4 including an interconnecting link having means at one end interacting with said closing lever and connecting with a closing link at an opposite end thereof.

6. The circuit breaker of claim 5 wherein said closing link includes means at one end receiving a part of said interlock link thereby controlling travel of said closing link when said close means is actuated.

7. The circuit breaker of claim 6 wherein said closing link further includes an end arranged for interacting with said primary latch.

8. The circuit breaker of claim 6 wherein said primary latch includes a bracket, said primary latch being carried on said bracket.

9. The circuit breaker of claim 6 wherein said closing link comprises a rectangular slot defined in a top thereof.

10. The industrial-rated circuit breaker of claim 9 wherein said interlock link includes a tab captured within said rectangular slot.

* * * * *